US005639105A

United States Patent [19]

Summo

[11] Patent Number: 5,639,105

[45] Date of Patent: Jun. 17, 1997

[54] OCCUPANT PROPELLED APPARATUS FOR THERAPY, EXERCISE AND MOBILITY-PARTICULARLY FOR CHILDREN

[75] Inventor: Michael William Summo, Brewster, N.Y.

[73] Assignee: Michael W. Summo, Brewster, N.Y.

[21] Appl. No.: 453,238

[22] Filed: May 30, 1995

[51] Int. Cl.[6] ..... A61G 5/02

[52] U.S. Cl. ..... 280/250.1; 280/149.2; 297/DIG. 4

[58] Field of Search ..... 280/250.1, 87.01, 280/87.021, 149.2; 297/DIG. 4

[56] References Cited

U.S. PATENT DOCUMENTS

| | | | |
|---|---|---|---|
| 2,869,686 | 1/1959 | Glanz | 280/250.1 X |
| 4,128,137 | 12/1978 | Booth | 280/250.1 X |
| 4,310,167 | 1/1982 | McLaurin | 280/250.1 X |
| 4,620,714 | 11/1986 | Davis | 280/250.1 |
| 4,744,578 | 5/1988 | Stearns | 280/250.1 |
| 4,997,200 | 3/1991 | Earls | 280/648 |
| 5,020,816 | 6/1991 | Mulholland | 280/250.1 |
| 5,242,180 | 9/1993 | Bergeron | 280/250.1 |

OTHER PUBLICATIONS

1993–1994 Catalog Excerpts: Rifton for People with Disabilities; Front Cover, Back Cover, and Highlighted Items on Pages 17, 23, 31 and 37.

Spring 1995 Catalog Excerpts: Flaghouse, Inc., Special Populations; Front Cover, Back Cover, and Highlighted Items on Pages 32, 33 and 35.

*Primary Examiner*—Kevin Hurley

[57] ABSTRACT

The present invention discloses a medical apparatus to be utilized in therapy for disabled or injured persons. The apparatus incorporates physical therapy, orthopedic therapy, occupational therapy, exercise, positive psychological effects, and an improved ability for social interaction. The apparatus has a generally rectangular base plate (20) supported on a ground support surface by a small swivel caster (26), large swivel casters (28), and larger traction wheels (34) which are rotatably mounted to the base plate (20) and allows the occupant mobility through self propulsion. The apparatus has a back rest (50), back rest brace assembly (52), and orthopedic bracing system which are adjustable and removable. Therapeutic value is provided since the apparatus can be used in either a seated position, reclined seated position, horizontal prone position or in a horizontal supine position. The apparatus is a single medical device that can accomplish multiple functions by providing the option of placing the occupant in a variety of beneficial body positions. The therapeutic value obtained from use in multiple body positions allows flexing of the spine, bones, joints, and muscles through a range of motion of flexion and extension. In addition to the multiple body positions provided, the apparatus has a slidable traction wheel assembly (30) and adjustable back rest (50) which develops muscle strength and coordination directed toward specific muscle groups. Furthermore, the adjustable orthopedic bracing system on the apparatus can improve and/or prevent deformities of the musculoskeletal system. The apparatus can be configured and adjusted with human hands and does not require special tools.

11 Claims, 5 Drawing Sheets

OCCUPANT PROPELLED APPARATUS FOR THERAPY, EXERCISE AND MOBILITY-PARTICULARLY FOR CHILDREN

BACKGROUND

1. Field of Invention

The present invention relates to an adjustable occupant propelled mobility apparatus that can be utilized in the therapy of children with disabilities and children recuperating from injury or surgery while providing orthopedic therapy in a variety of body positions.

2. Description of the Related Prior Art

There are several forms of prior art that are known to the applicant. The prior art includes several types of occupant propelled multi-wheeled vehicles and other medical devices that are currently manufactured products or U.S. Patents. Many of these products and U.S. Patents have the limitation of being generally designed as a mode of transportation.

Regarding the manufactured products, there are a number of physical therapy and mobility products for children currently available. These products are generally known as:

1. Wheelchairs, which are for transportation, where the occupant is placed in a seated position.
2. Mobility carts, a small wheelchair-like product, where the occupant is placed in a seated position.
3. Scooter boards, scooters or caster carts, which are dolly like devices that generally incorporate a flat piece of plywood with swivel casters, one mounted at each corner, where the occupant is placed lying face down with the front of their body in contact with the device.
4. Prone standers or positioners, which generally incorporate a flat piece of plywood, to act as a body support board, mounted onto a metal or wood frame stand, in which the occupant is placed and secured with their stomach and the front of their legs in contact with the plywood, and
5. Supine boards, which generally incorporate a flat piece of plywood, to act as a body support board, mounted onto a metal or wood frame stand, in which the occupant is placed and secured with their back, and the back of their legs in contact with the plywood.

The limitations and disadvantages of these manufactured products are that adjustability for specific muscle group physical therapy and exercise is not incorporated into their design. Relating to the wheelchairs, mobility carts, and scooter boards, the child is either placed into a seated position, where the back support structure remains at a fixed angle, or the child is placed in a horizontal prone position. This creates a condition where one group of muscles and joints provides the force for propulsion, and selecting concentration to a specific musculoskeletal group through adjustability is not available. Another disadvantage of these types of devices is that the occupant only has the option of being placed and secured onto the device in one body position, either seated in the wheelchair and mobility cart, or lying flat on the scooter board since the body support board is rigid. The fixed angle of the back support structure on the wheelchair and mobility cart, and non-adjustable rigidity of the scooter board, does not allow flexing the spine, thereby preventing movement of the spine through a range of motion of flexion and extension.

Although the wheelchair and mobility cart provide increased mobility, the inherent design places the occupant in a seated position, thereby increasing muscle atrophy and becoming prone to lower internal organ failure. It has been shown that children with disabilities benefit from the use of wheelchairs, mobility carts, scooter boards, prone devices and supine devices, and that being placed in the prone position benefits children who need to develop head, shoulder, and trunk extension. Although the prior art can provide these options, the patient requires purchasing separate products, instead of having the availability of one piece of medical apparatus to meet all of these needs.

In the manufactured products, the wheels are secured at fixed locations, preventing adjustment to the child's special needs. The fixed wheel locations also prevent adjustment to the wheelbase dimensions of these products, which places limits on the maneuverability. The fixed wheel locations also prevent a change in the elevation of the wheels with respect to the ground surface, which forces all of the wheels to have an even distribution of the load into the ground surface simultaneously. Since all of the wheels contact the ground surface simultaneously, the wheels are arranged to carry a balanced weight of the occupant and vehicle.

The existing manufactured products of wheelchair, mobility cart, and scooter board devices lack an adjustable orthopedic brace system and therefore do not have the ability to provide orthopedic therapy. The lack of a bracing system through adjustable orthopedic braces prevents these existing products from being utilized for providing general body support. The lack of orthopedic braces does not allow for the prevention and/or correction of long bone deformation or torsional deformities from birth defects or other conditions.

Other types of existing manufactured products that are available are known as prone standers, prone positioners, and supine boards, which generally incorporate a flat piece of plywood, to act as a body support board, mounted onto a metal or wood frame stand. In the prone devices, the occupant is secured into this device with their stomach and the front of their legs in contact with the flat plywood, and then secured into place with straps or braces. In the supine devices, the occupant would be placed with their back and the back of their legs in contact with the plywood, and then secured with straps and braces. The disadvantages of these types of prone and supine devices are that the occupant only has the option of being placed and secured onto the device in one body position since the body support board is rigid and that this non-adjustable rigidity does not allow flexing the spine into a seated position, thereby preventing movement of the spine through a range of motion of flexion and extension.

Through research of the prior art, it does not appear that the supine board device is available for occupant propulsion. Some of these supine devices are designed to remain stationary with respect to the ground surface and are not mobile. Other supine devices have swivel casters but no available means for the occupant to propel the device. Propulsion for mobility must come from second party intervention.

Regarding the prone devices, some are designed to remain stationary with respect to the ground surface and are not mobile. Other prone devices have swivel casters but no available means for the occupant to propel the device. Propulsion for mobility must come from second party intervention. Several versions of prone standers are available with swivel casters and wheelchair type traction wheels and the occupant can propel themselves.

With the exception of the prone devices that have wheelchair wheels, the occupant cannot propel themselves and therefore cannot accomplish the benefits of physical therapy and exercise through self propulsion and does not gain the psychological benefits of independent self mobility. In these devices the wheels are also secured in fixed locations.

The U.S. Patents disclose several types of vehicles that appear to be mainly for transportation purposes and are generally lacking with regard to therapeutic value and exercise function. Many of the limitations and disadvantages that have been discussed previously are also applicable to the cited U.S. Patents. Further discussion of the disclosed patents follows:

U.S. Pat. No. 2,869,686 to Glanz (1959) discloses a hand operated toy car that has fixed wheel locations in which all wheels contact ground surface simultaneously as well as a back support that remains at a fixed angle. With this wheel configuration there is a constant wheelbase dimensions that cannot be adjusted.

U.S. Pat. No. 4,620,714 to Davis (1986) discloses an ambulatory wheelstand that has fixed wheel locations in which all wheels contact ground surface simultaneously. The wheelstand does show an adjustable body support that can move the occupant in a range of angles between vertical and horizontal. When placed in this body support, the occupant remains in a flat prone position that does not allow movement of the spine through a range of motion of flexion and extension. Although the occupant can be moved to a horizontal prone position, the occupant cannot propel themselves to simulate the crawling action exercise and coordination obtained by a normal infant utilizing arm and leg propulsion on the ground surface.

U.S. Pat. No. 4,997,200 to Earls (1991) discloses a combination wheelchair-gurney apparatus that has fixed wheel locations in which all wheels contact the ground surface simultaneously. The wheelchair-gurney has a back support plate that moves to the reclining position, but it is not adjustable throughout the range of motion. The back support plate can only remain in the full vertical or full horizontal position.

U.S. Pat. No. 5,020,816 to Mulholland (1991) discloses an adjustable frame wheelchair. The wheelchair has four load bearing wheels that simultaneously contact the ground surface. Adjustable traction wheel positions are attainable, but if the traction wheels are moved too far forward, the center of gravity of the wheelchair and occupant would shift and the wheelchair would tip backward. The adjustable traction wheel capability does not appear to be for physical therapy and localized muscle group exercise. In addition, the device has a back support that remains at a fixed angle.

U.S. Pat. No. 5,242,180 to Bergeron (1993) discloses a prone stander. The weight of the occupant is distributed through the traction wheels and the single rear caster, but the fixed locations of the wheels does not allow adjustment of the wheelbase. The front caster does not contact the ground simultaneously with the other three wheels. Due to the inherent center of gravity of the device, the weight remains rearward and the front caster is never in contact the ground surface, according to Bergeron Patent Column 6, Lines 2 through 8.

Further limitations and disadvantages of the prior art will become apparent throughout the patent application presented.

SUMMARY OF THE INVENTION

The objects and advantages of the present invention relate to an adjustable occupant propelled apparatus that can be utilized in the physical therapy of children with disabilities and children recuperating from injury or surgery. The apparatus serves many functions relating to therapeutic value. The present invention incorporates physical therapy, orthopedic therapy, occupational therapy, exercise, positive psychological effects, and an improved ability for social interaction. The present invention could be used to treat children with afflictions including but not limited to musculoskeletal deformities, neuromuscular disorders, central nervous system malformations, peripheral nerve injuries, traumatic head injuries, mental retardation, paralysis of the lower extremities, and other injuries and birth defects. The present invention is a versatile apparatus that can be used to implement a long range therapeutic management plan that will be required by the child as they grow and develop.

Relating to the exercise and physical therapy aspects of the present invention, the purpose of the apparatus is to develop muscle strength and endurance as well as gross motor control and coordination of specific muscle groups. The muscle therapy can be localized by placing the child in a plurality of body positions. The apparatus can be used in either a seated position, horizontal prone position or horizontal supine position. In these different positions, the child can do standard exercises, such as sit ups and push ups as well as isometric exercises. The therapeutic value attained by using the present invention develops the muscle strength and coordination that will be required for the recuperating able bodied child to become ambulatory again, and prepares the disabled child for future mobility using a walker, crutches, wheelchair or crutches and braces. The present invention also provides early intervention use as a wheelchair training device for an infant to obtain the required strength and coordination to steer and maneuver a standard wheelchair.

The present invention also provides orthopedic therapy through an adjustable orthopedic brace system. Relating to the orthopedic therapy of the apparatus, the present invention is designed to help align and position the body by allowing the Doctor or Physical Therapist to adjust the seat rest, hip and leg braces in conjunction with center leg brace assembly in order to achieve the maximum effect for orthopedic therapy. The general nature of a child's bony skeletal material is that it is soft and pliable prior to ossification when the bone calcifies and becomes hardened. This soft bone can yield and deform from muscle imbalance. In addition, deformed childhood bones can be straightened by the use of support and corrective forces. The adjustable orthopedic brace system incorporated into the apparatus allows the Doctor or Physical Therapist to prevent or correct these types of childhood bony deformities through orthopedic and manipulative treatment. In addition, the design incorporates this adjustability without the use of any special tools and all adjustments to the hardware are made by using human hands. The adjustable orthopedic brace system can be used in conjunction with conventional braces, splints and/or body casts that are worn by the child, if desired. The orthopedic braces can be adjusted to prevent and/or correct long bone deformation or torsional deformities from birth defects, muscle imbalance, muscle spasticity, muscle hypertonia, and muscle hypotonia. Optional padding, restraining straps and braces that are available from existing manufacturers can also be mounted onto the present invention, if desired, to obtain a therapeutic effect. The apparatus allows the child to be placed into a comfortable position while receiving the required orthopedic therapy. While this orthopedic therapy is being received, the apparatus offers the option of the child being independently mobile, playing or quietly working while being stationary.

Therapeutic value is also provided since the apparatus has adjustable support structures designed to support the user in a variety of positions such as a seated position, reclined seated position, horizontal prone position or horizontal supine position. The present invention is a single medical apparatus that can accomplish the functions of many products by providing the option of placing the child in a variety of beneficial body positions. A wheelchair occupant in a seated position has an increased potential for muscle atrophy and becoming prone to lower internal organ failure. The adjustability of the present invention allows flexing of the muscles, spine, joints, and bones into a plurality of positions, thereby maintaining and increasing the range of motion of the joints and muscles while decreasing the potential for muscle atrophy. It has been shown that children with Spina Bifida benefit from the use of prone devices, and that being placed in the prone position benefits children who need to develop head, shoulder, and trunk extension. The overall adjustable features of the apparatus are important aspects to accommodate children with disabilities, since continual adjustment will be required as the child grows and their musculoskeletal conditions change.

Relating to the occupational therapy aspects of the apparatus, the present invention gives the child a sense of body awareness and visual perception. Occupational therapy helps children achieve the self help, play, and learning skills that are appropriate for their age. The Occupational Therapist can use the apparatus to help the child develop the self help skills that are necessary for every day life. Visual perception development, called motor planning, can be implemented by teaching the child to maneuver the apparatus through a doorway or obstacle course. In the seated position, the child can develop upper body (trunk) balance as well as hand and arm control. These are daily living skills that are necessary for activities such as eating, putting on a shirt and holding up the arm to switch on a light.

The present invention offers therapeutic value regarding the positive psychological effects and social interaction skills that are attained by utilizing the apparatus. Since the apparatus is designed for occupant propulsion without second party intervention, the child develops self esteem through self mobility and independent movement. The height and physical position that the present invention places the child at is a more normal elevation for social interaction with infants that are crawling and toddlers that are walking. Since the apparatus is low to the ground, if the child drops an item such as a toy or a crayon, they can retrieve it themselves. The apparatus can be utilized as a therapeutic tool which makes physical therapy fun by allowing them to explore their environment in a more normal fashion.

The physical size of the apparatus makes it easily transportable without disassembly. This portability allows easy transportation for utilization of the apparatus for supplemental physical therapy and mobility outside of the formal hospital physical therapy sessions that these children require, such as in the home, school, early intervention groups or in a child's play group. In addition, the upper surfaces of the hip and leg braces, and center leg brace assembly can be utilized to support a tray, lap desk, books, puzzles, drawing pads, games, toys or other rigid items that can be incorporated into therapy, educational uses or play time.

The present invention has a five wheel design, but the five wheels do not contact the ground surface simultaneously. The wheel configuration consists of two traction wheels which are used for propelling and steering the apparatus, and three swivel casters. The propulsion and steering of the apparatus is accomplished by placing the hands on the tire tread portion of the traction wheels and rotating the wheels about the traction wheel axle using a similar upper extremity action and mode of operation as would be used to propel and steer a standard occupant propelled wheelchair. The swivel caster locations are such that one small swivel caster is centered and secured at the rear of the base plate underside, and two large swivel casters are secured at the front corners of the base plate underside. The location of the slidable traction wheel assembly is adjustable along the underside of the base plate, between the small and large swivel casters.

In the seated position, the adjustable back rest and/or slidable traction wheel axle allows the apparatus to be used on a short triangular wheelbase (the rear three wheels contacting the ground surface) for easier resistance on the traction wheels and increased maneuverability or, on a long rectangular wheelbase (front four wheels contacting the ground surface) providing greater resistance on the traction wheels. This is accomplished by shifting the center of gravity of the child's body by changing the location of the slidable traction wheel assembly and/or back rest angle. In addition, the Doctor or Physical Therapist can adjust the back rest angle and slidable traction wheel assembly location in order to exercise different muscle groups. The Doctor or Physical Therapist also has the option of loading the apparatus with weights to bring the desired wheelbase configuration in contact with the ground. The additional weight would increase the force required to rotate the traction wheels, requiring an additional muscular effort on the part of the occupant in order to propel and steer the apparatus.

Since the apparatus is designed such that the wheels do not contact the ground surface simultaneously, there is a gap between the small or large swivel casters and the ground surface while the traction wheels remain in continuous contact with the ground surface. This gap provides protection in the event that someone steps on the apparatus, or another child sits on the ends of the apparatus, the apparatus will only drop the distance of the gap before the corresponding caster(s) contacts the ground surface. This limits the distance travelled so as to minimize any sudden jar to the child in the event of an accident. The base plate shape and five (5) wheel placement design will provide stability to prevent overturning of the apparatus.

In addition, the apparatus pivots in the vertical plane about the axle of the traction wheels. This allows the traction wheels to remain in contact with the ground surface and the apparatus will remain mobile when going over ground surface areas of different elevation, such as over a door threshold or from a carpeted area to a non-carpeted area. Although it is designed as a therapeutic tool, the five (5) wheel design also allows the apparatus to be operated on a variety of ground surfaces, such as on a grass lawn or on high pile carpeting.

Beside the traction wheel rotational exercises, the hip and leg braces can be used as parallel bars to do wheelchair dip exercises, standard dip exercises or other parallel bar exercises when the center leg brace assembly is removed. With the center leg brace assembly removed, the child can also propel the apparatus with their legs by sitting on the base plate with their legs overhanging the front of the apparatus, and propelling and steering the apparatus using the legs with the feet in contact with the ground surface.

In the horizontal prone position, the present invention offers exercise of the upper extremities and lower extremities. In the horizontal prone position, the intent of the physical therapy is to develop muscle groups that a normal child would develop in the ambulatory crawling stage of infancy. The apparatus is set up for the horizontal prone position utilizing arm propulsion by removing the back rest and back rest brace assembly. The child is placed with their sternum facing down over the single small swivel caster and their feet near the two large swivel casters. Propulsion of the apparatus is provided by the upper extremities from the child using their hands on the ground surface. This propulsion develops upper body muscle strength and endurance, while steering the apparatus develops muscle coordination. In the horizontal prone position utilizing arm propulsion, additional physical therapy can be provided by the child doing upper body standard push up exercises. The push up exercises increase upper body muscle strength and coordination by moving the elbow, shoulder joints, and muscles through a range of motion of flexion and extension.

The apparatus is set up for the horizontal prone position utilizing leg propulsion by removing the back rest, back rest brace assembly and center leg brace assembly. The child is placed with their stomach facing down centered over the two large swivel casters and their shoulders near the traction wheels with their hands placed on the upper surface of the base plate. Propulsion of the apparatus is provided by the lower extremities from the child using their knees and toes.

The traction wheels and axle can be removed to offer the option of utilizing the present invention as a scooter board (dolly) where the three swivel casters would contact the ground surface simultaneously.

The apparatus is set up for the horizontal supine position utilizing traction wheel rotation propulsion by removing the back rest and back rest brace assembly. The apparatus is lengthened at the rear with the head rest extension plate and the apparatus can be utilized as a supine board. In this configuration, the child would be placed with their back facing down, the back of their legs contacting the base plate, and the back of their head contacting the head rest extension plate. This position can provide self mobility by the child rotating the traction wheels with their hands in a mode of operation similar to propelling and steering a standard occupant propelled wheelchair.

The present invention overcomes the disadvantages of the prior art by providing a single medical apparatus that can accomplish a large variety of therapeutic and social functions. The present invention, unlike the prior art disclosed, allows the child to be placed in a plurality of body positions to maximize the desired therapeutic effect and minimize muscle atrophy. Moreover, the selectable positions of the traction wheels and back rest allows adjustment to concentrate muscular exercise and physical therapy while providing a customized fit to the child's musculoskeletal system. The orthopedic bracing system provides support to prevent or correct musculoskeletal conditions and allows the child to enjoy independent mobility. The physical size of the present invention makes it easily transportable. The low elevation of the present invention places the child at an optimum level for peer interaction.

Further objects, features and advantages of the present invention will become apparent from a consideration of the drawings and ensuing descriptions.

REFERENCE NUMERALS IN DRAWINGS

Figure 1:
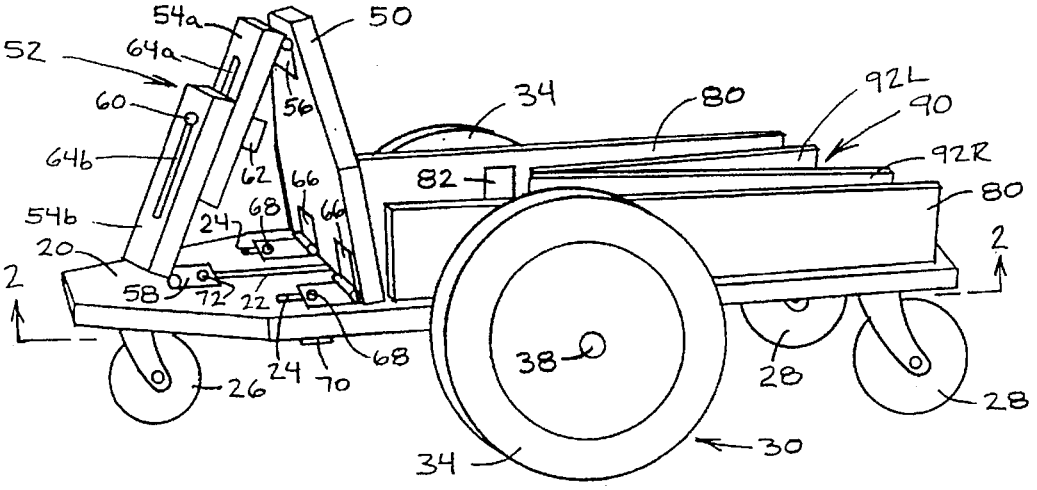
FIG. 1 is an elevated perspective view of the apparatus completely assembled for the seated position.

20 base plate
22 milled center slot
24 milled side slot
26 small swivel caster
28 large swivel caster
30 slidable traction wheel assembly
32 traction wheel axle
34 traction wheel
36 spacer bushing
38 push nut
40 axle cover
42 milled groove
44 carriage bolt (machine threaded)
46 bar nut (machine threaded)
48 adjustable seat belt strap
50 back rest
52 back rest brace assembly
**54*a*** back rest brace upper element
**54*b*** back rest brace lower element
56 hinge
58 hinge
60 carriage bolt (machine threaded)
62 bar nut (machine threaded)
**64*a*** milled slot
**64*b*** milled slot
66 hinge
68 carriage bolt (machine threaded)
70 bar nut (machine threaded)
72 carriage bolt (machine threaded)
74 bar nut (machine threaded)
76 adjustable torso strap
78 adjustable leg strap
80 hip and leg brace
82 support bracket
84 milled slot
86 carriage bolt (machine threaded)
88 bar nut (machine threaded)
90 center leg brace assembly
92L center left leg brace element
92R center right leg brace element
94 support bracket
96 hinge
98 milled slot
100 carriage bolt (machine threaded)
102 bar nut (machine threaded)
104 head rest extension plate
106 carriage bolt (machine threaded)
108 bar nut (machine threaded)

DETAILED DESCRIPTION OF THE PREFERRED EMBODIMENT

Figure 4:
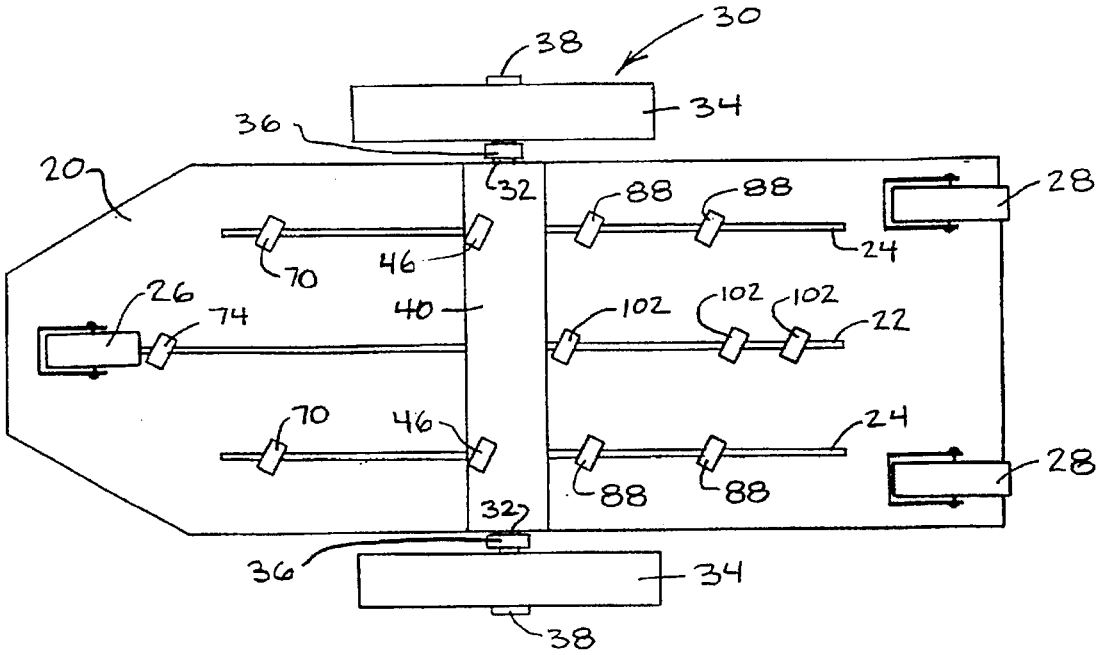
FIG. 4 is a plan view of the underside of the apparatus.
Figure 5:
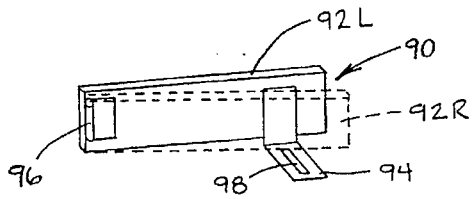
FIG. 5 is an elevated perspective view of the center leg brace assembly.

With reference to FIGS. 1 and 4, a base plate 20 is an elongate piece of flat rigid material of wood or like material.

A milled center slot 22 is cut through base plate 20 along the center line of the upper side of base plate 20 parallel to the edge of the long direction of base plate 20. Two milled side slots 24 are cut through base plate 20 at an equally spaced distance on the upper side of base plate 20 and in a direction parallel to the edge of the long direction of base plate 20. A small swivel caster 26 is secured to the underside of the thin tapered end of base plate 20. Two large swivel casters 28 are secured to the underside of base plate 20 at the ninety degree corners. The length of milled center slot 22 begins approximately at a point perpendicular to the underside mounting of large swivel casters 28 and terminates approximately at the underside mounting of small swivel caster 26. The length of milled side slots 24 begins at a point perpendicular to the underside mounting of large swivel casters 28 and terminates approximately at the beginning of the taper on the long edge of base plate 20. Base plate 20 has a generally rectangular overall shape that is cut and begins to taper on the long edge at an approximate point perpendicular to the end of milled side slots 24. The tapering terminates at the end of the base plate 20 near small swivel caster 26 and forms the shape of an isosceles trapezoid at this end of the base plate.

Figure 2:
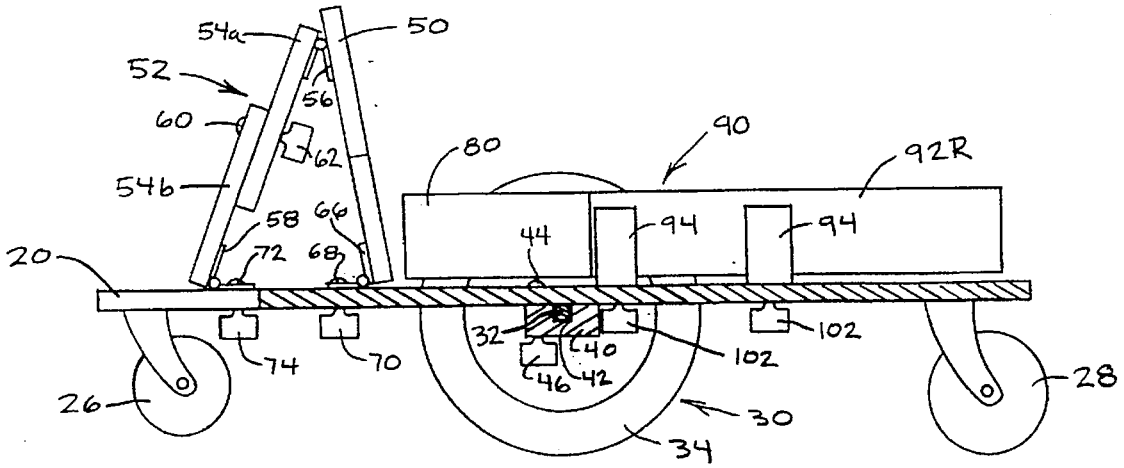
FIG. 2 is an elevated cross sectional view of the apparatus indicated by the section lines 2—2 in FIG. 1.
Figure 3:
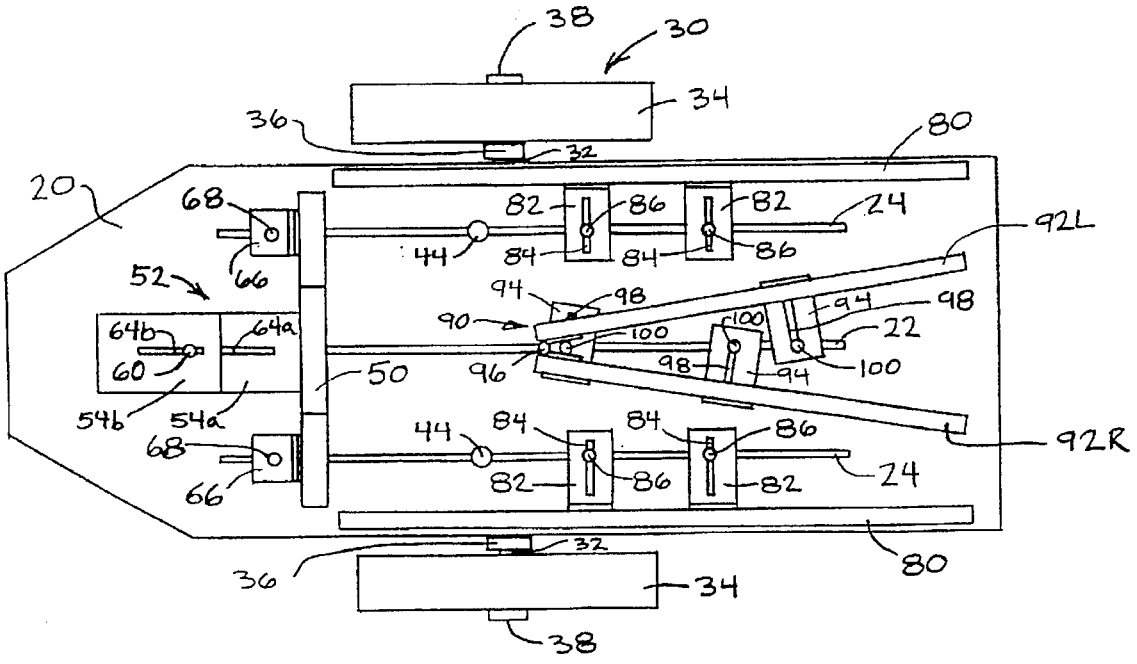
FIG. 3 is an aerial plan view of the of the apparatus.

With reference to FIGS. 2–4, a slidable traction wheel assembly 30 is secured to the underside of base plate 20. Slidable traction wheel assembly 30 is comprised of a traction wheel axle 32 of cold rolled steel or like material with a round cross sectional shape, two traction wheels 34 and two spacer bushings 36 which are contained on traction wheel axle 32 at each end with two push nuts 38. Slidable traction wheel assembly 30 is secured to the underside of base plate 20 with an axle cover 40. Axle cover 40 is an elongate piece of wood or like material with a rectangular shape and rectangular cross section. The length of axle cover 40 is the same dimension as the width of base plate 20. A milled groove 42 is cut in the upper side center line of axle cover 40 parallel to the long edge of axle cover 40. The width and depth of milled groove 42 is the same as the diameter of traction wheel axle 32. Traction wheel axle 32 is centered and installed in milled groove 42 in axle cover 40. Spacer bushings 36 and traction wheels 34 are installed on exposed ends of traction wheel axle 32 and secured in place with push nuts 38. Slidable traction wheel assembly 30 and axle cover 40 are attached to the underside of base plate 20 by two carriage bolts 44 installed through milled side slots 24 and coinciding circular holes drilled in axle cover 40 and secured with two bar nuts 46.

With reference to FIGS. 1–4, a back rest 50 is a flat rigid piece of wood or like material. Back rest 50 is generally a square overall shape that is cut to taper from a point halfway up the elevated side which forms an isosceles trapezoidal shape on the upper half. The width of back rest 50 is a dimension less than the width of base plate 20 in order to allow the slidable placement of back rest 50 at any point on base plate 20 at an angle perpendicular to milled center slot 22. A back rest brace assembly 52 is comprised of a back rest brace upper element **54*a*, a back rest brace lower element 54*b*, a hinge 56, a hinge 58, a carriage bolt 60 and a bar nut 62. Back rest brace upper element 54*a* and back rest brace lower element 54*b* are elongate flat rigid pieces of wood or like material in a generally rectangular in shape. A milled slot 64*a* is cut through the wide face of back rest brace upper element 54*a* along the center line of the wide face in a direction parallel to the long edge of back rest brace upper element 54*a*. A milled slot 64*b* is cut through the wide face of back rest brace lower element 54*b* along the center line of the wide face in a direction parallel to the long edge of back rest brace lower element 54*b*. Back rest brace upper element 54*a* and back rest brace lower element 54*b* are overlapped slightly on the wide faces and carriage bolt 60 is installed through the milled slots 64*a* and 64*b* and secured in place with bar nut 62. Hinge 56 is secured to back rest brace upper element 54*a* and is secured to the center line of the tapered end of back rest 50. Hinge 58 is secured to back rest brace lower element 54*b***.

Back rest 50 is located and centered in a direction perpendicular to the long edge of base plate 20. Two hinges 66 are secured to the rear side of back rest 50 at locations corresponding to the milled side slots 24 in base plate 20. Back rest 50 is secured to base plate 20 by installing two carriage bolts 68 through square holes cut in hinges 66 which then pass through milled side slots 24 and are secured to the underside of base plate 20 with two bar nuts 70. Back rest brace lower element **54*b* is secured to base plate 20 by installing a carriage bolt 72 through a square hole cut in hinge 58 which then pass through milled center slot 22 and is secured to the underside of base plate 20 with a bar nut 74**.

With reference to FIGS. 1–4 again, a hip and leg brace 80 is an elongate flat rigid piece of wood or like material that has a generally rectangular shape. A support bracket 82 of steel band iron or like material is formed to a ninety degree angle. A milled slot 84 is cut through the lower wide face of support bracket 82 and is centered in a direction parallel to the long edge of support bracket 82. Two support brackets 82 are secured to each of hip and leg braces 80. Support brackets 82 are secured to base plate 20 by installing a carriage bolt 86 through the milled slots 84 which then pass through milled side slots 24 and are secured to the underside of base plate 20 with a bar nut 88.

With reference to FIGS. 1–5, a center leg brace assembly 90 is comprised of a center left leg brace element 92L, a center right leg brace element 92R, three support brackets 94 and a hinge 96. Center left leg brace element 92L and center right leg brace element 92R are elongate flat rigid pieces of wood or like material that have a generally rectangular shape and are of the same dimensions. Support bracket 94 of steel band iron or like material is formed to a ninety degree angle. A milled slot 98 is cut through the lower wide face of support bracket 94 and is centered in a direction parallel to the long edge of support bracket 94. Support bracket 94 is secured to center left leg brace element 92L. Two support brackets 94 are secured to center right leg brace element 92R. Hinge 96 is centered vertically and secured to center left leg brace element 92L and center right leg brace element 92R. Support brackets 94 are secured to base plate 20 by installing a carriage bolt 100 through the milled slots 98 which then pass through milled center slot 22 and are secured to the underside of base plate 20 with a bar nut 102.

Figure 10:
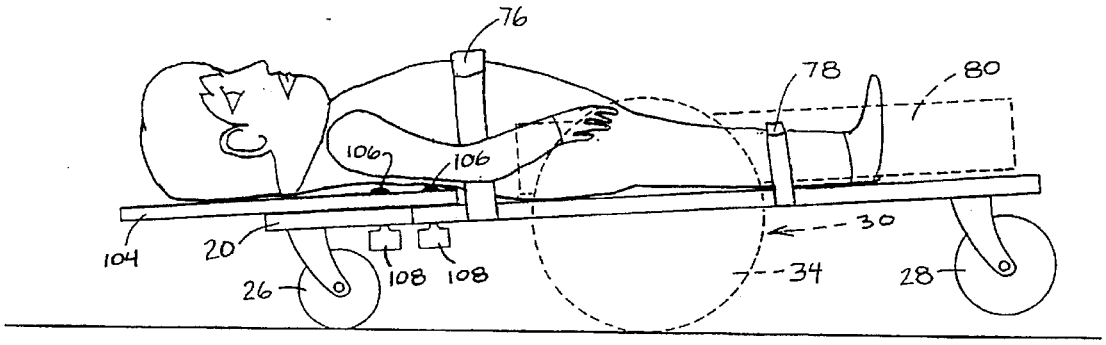
FIG. 10 is a side elevation view of the apparatus with the child placed in the horizontal supine position utilizing traction wheel rotation propulsion.

With specific reference to FIGS. 1 and 10, a head rest extension plate 104 is a flat rigid elongate piece of wood or like material that has a generally rectangular shape. Head rest extension plate 104 is secured to base plate 20 by installing two carriage bolts 106 through two round holes cut through the center line of the upper side of head plate extension plate 104 which then pass through milled center slot 22 and are secured to the underside of base plate 20 with two bar nuts 108.

MODE OF OPERATION—SEATED POSITION

Figure 6:
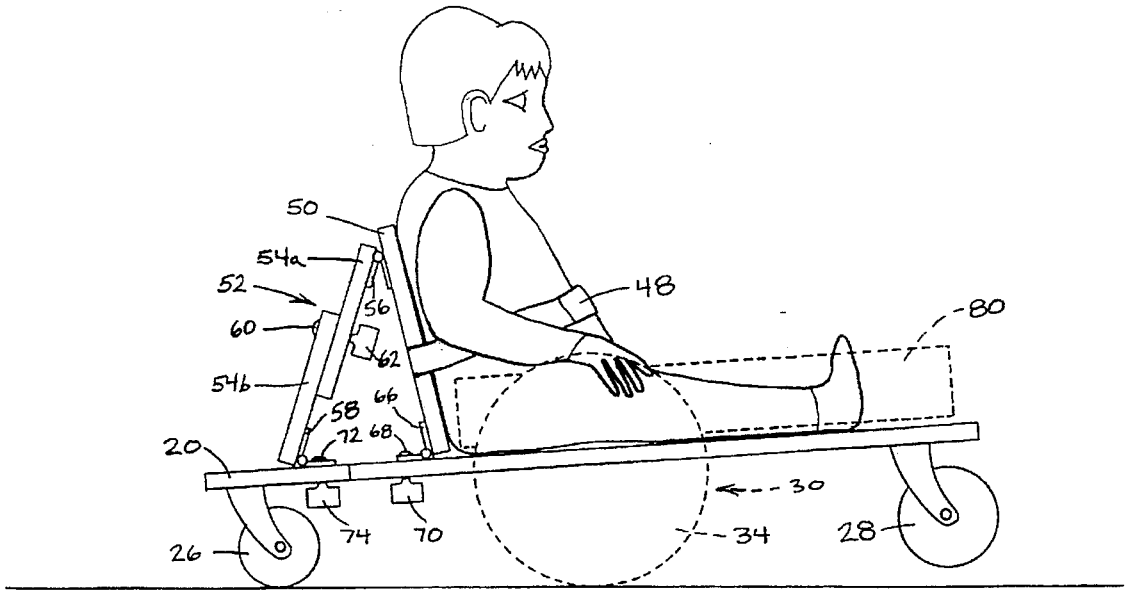
FIG. 6 is a side elevation view of the apparatus with the child placed in the seated position utilizing traction wheel rotation propulsion.

With specific reference to FIG. 6, the child is placed in a seated position with their buttocks and the back of their legs in contact with the upper surface of base plate 20 and with their back in contact with the flat surface of back rest 50. The child is then secured into position with an adjustable seat belt strap 48 which is wrapped around the rear of back rest 50 and secured around the child's stomach. Adjustable seat belt strap 48 is not connected or attached to back rest 50 and the child is secured into position by the tightening of adjustable seat belt strap 48.

With reference to FIGS. 1–6, back rest 50 can be adjusted to a plurality of angles relative to the upper surface of base plate 20 by loosening bar nut 62 and selecting the desirable position by changing the length of back rest brace assembly 52. The angle of back rest 50 relative to base plate 20 can also be adjusted by loosening bar nuts 70 and sliding hinges 66 to a plurality of positions along milled side slots 24. Once the desirable angle of back rest 50 is obtained, bar nuts 70 and 62 would then be tightened to secure the adjusted components into a fixed position. Therapeutic value is provided since the apparatus can be used in either an upright seated position or reclined seated position which allows the spine and muscles to be placed trough a range of motion of flexion and extension.

In the seated position, the child would propel the apparatus by placing their hands on the tire tread portions of traction wheels 34 and either push or pull on these wheels in order rotate the wheels about traction wheel axle 32. This upper extremity action and mode of operation to steer and propel the apparatus, is similar to the action used for a standard occupant propelled wheelchair. The upper portion of back rest 50 is tapered to facilitate arm movement and shoulder rotation to allow the muscles and joints to move through a range of motion of flexion and extension to obtain the maximum therapeutic effect during physical therapy and mobility use of the present invention.

The present invention has a five wheel design, but small swivel caster 26 and large swivel casters 28 do not contact the ground surface simultaneously. Traction wheels 34 remain in constant contact with the ground surface in order to propel and steer the apparatus.

In the seated position, the adjustable position of back rest 50 and/or the location of slidable traction wheel assembly 30 allows the apparatus to be used on a short triangular wheelbase (the rear three wheels contacting the ground surface) for easier resistance on traction wheels 34 and increased maneuverability or, on a long rectangular wheelbase (front four wheels contacting the ground surface) providing greater resistance on traction wheels 34. This is accomplished by shifting the center of gravity of the child's body by changing the location of slidable traction wheel assembly 30 and the position of back rest 50 in order to bring the desired caster(s) 26 or 28 into contact with the ground surface. The location of slidable traction wheel assembly 30 is adjusted to the desirable position by loosening bar nuts 46 and selecting a position along the length of milled side slots 24 while maintaining the long edge of axle cover 40 at an angle perpendicular to milled center slot 22.

The Doctor or Physical Therapist can adjust the position of back rest 50 and position of slidable traction wheel assembly 30 in order to concentrate exercise on different muscle groups. The Doctor or Physical Therapist also has the option of loading the apparatus with weights to bring the desired wheelbase configuration in contact with the ground. The additional weight would also increase the force required to rotate traction wheels 34 about traction wheel axle 32, thereby requiring an additional muscular effort on the part of the occupant in order to propel and steer the apparatus.

Since the apparatus is designed such that swivel casters 26 and 28 do not contact the ground surface simultaneously, there is a gap between either small swivel caster 26 or large swivel casters 28 and the ground surface while traction wheels 34 remain in continuous contact with the ground surface. This gap provides protection since the apparatus will only drop the distance of the gap before the corresponding caster(s) contacts the ground surface. This limits the distance travelled so as to minimize any sudden jar to the child in the event of an accident. The shape of base plate 20 and five (5) wheel placement design will provide stability to prevent overturning of the apparatus.

The apparatus pivots in the vertical plane about traction wheel axle 32. This feature in conjunction with the aforementioned gap between the ground surface and either small swivel caster 26 or large swivel casters 28 prevents the present invention from becoming immobile when going over ground surface areas of different elevation, such as over a door threshold or from a carpeted area to a non-carpeted area by allowing traction wheels 34 to remain in constant contact with the ground surface, thus providing the required friction on traction wheels 34 to propel the apparatus.

Rotational exercises utilizing traction wheels 34 are accomplished in several different ways. The child would place their hands on the tire tread portions of traction wheels 34 and push to propel the apparatus forward by forcing an extension of the elbow joint and rotation of the shoulder joint. The child would pull on the tire tread portion of traction wheels 34 to propel the apparatus rearward by forcing a flexion of the elbow joint and shoulder joint. The apparatus could be spun in a circle by simultaneously pushing on one traction wheel 34 while pulling on the other traction wheel 34. The apparatus could be spun in a circle by concentrating all muscular effort on one side of the body by having the child place one hand on their stomach while using the other hand to either push or pull on the tire tread portion of traction wheel 34. In all of these modes of operation, the different arm and shoulder muscles are forced through a range of motion of flexion and extension.

Figure 7:
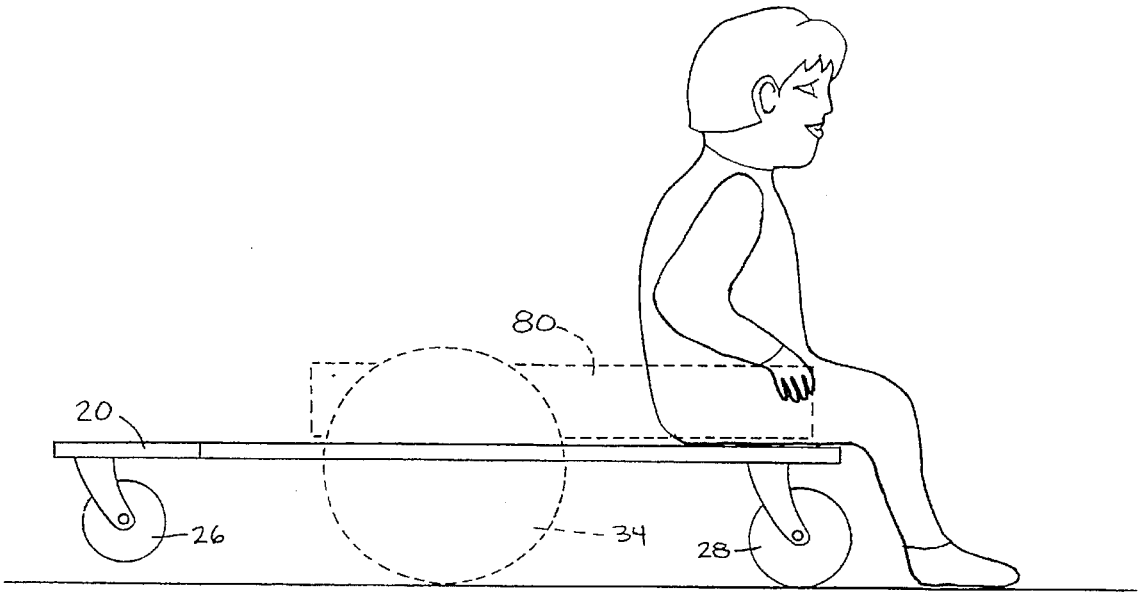
FIG. 7 is a side elevation view of the apparatus with the child placed in a seated position utilizing leg propulsion.

With specific reference to FIG. 7 and general reference to FIGS. 1–5, hip and leg braces 80 can be used as parallel bars to do wheelchair dip exercises, standard dip exercises or other parallel bar exercises. With center leg brace assembly 90 removed from base plate 20, the child can also propel the apparatus with their legs. This can be accomplished by sitting on base plate 20 with their legs overhanging the apparatus thereby propelling and steering the apparatus using the legs with the feet in contact with the ground surface. Center leg brace assembly 90 is removed from base plate 20 by removing bar nuts 102 from carriage bolts 100. Center leg brace assembly 90 can then be lifted upward from base plate 20 causing carriage bolts 100 to slide through milled center slot 22. These exercises can be performed with back rest 50 and back rest brace assembly 52 installed or removed from base plate 20.

Through the use of the present invention in the seated position, the child will develop muscle strength and endurance as well as gross motor control and coordination of specific muscle groups. The muscle therapy can be localized to specific muscle groups by placing the child in a plurality of seated body positions.

MODE OF OPERATION—HORIZONTAL PRONE POSITION

In the horizontal prone position, the present invention offers exercise of the upper extremities and lower extremities. In the horizontal prone position, the intent of the physical therapy is to develop muscle groups that a normal child would develop in the ambulatory crawling stage of infancy.

Figure 8:
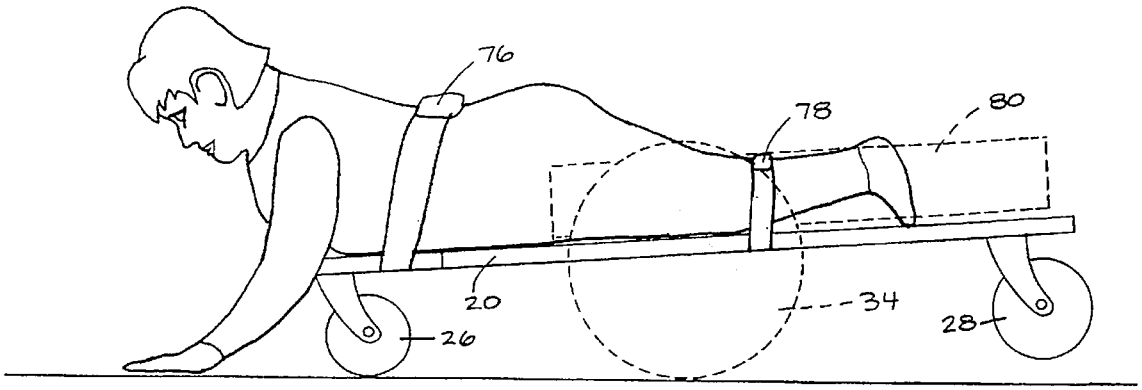
FIG. 8 is a side elevation view of the apparatus with the child placed in the horizontal prone position utilizing arm propulsion.

With specific reference to FIG. 8 and general reference to FIGS. 1–4, the present invention is prepared for use in the horizontal prone position utilizing arm propulsion by removing back rest 50 and back rest brace assembly 52 from base plate 20. Back rest 50 and back rest brace assembly 52 are removed from base plate 20 by removing bar nuts 70 from carriage bolts 68 and by removing bar nut 74 from carriage bolt 72. Back rest 50 and back rest brace assembly 52 can then be lifted upward from base plate 20 causing carriage bolts 68 and carriage bolt 72 to slide through milled center slot 22 and milled side slots 24.

The child is placed with their sternum facing down over small swivel caster 26 and their feet near large swivel casters 28 with their chest, stomach, and front of their legs in contact with the upper surface of base plate 20. The child is then secured into position with an adjustable torso strap 76 which is wrapped around the underside of base plate 20 and secured around the child's back. Adjustable torso strap 76 is not connected or attached to base plate 20 and the child is secured into position by the tightening of adjustable torso strap 76. The child is further secured into position with an adjustable leg strap 78 which is wrapped around the underside of base plate 20 and secured around the child's legs. Adjustable leg strap 78 is not connected or attached to base plate 20 and the child is secured into position by the tightening of adjustable leg strap 78.

Propulsion of the apparatus is provided by the upper extremities from the child using their hands on the ground surface. This propulsion develops upper body muscle strength and endurance, while steering the apparatus develops muscle coordination. In the horizontal prone position utilizing arm propulsion, additional physical therapy can be provided by the child doing upper body standard push up exercises by flexing and extending the elbow joint. The push up exercises increase upper body muscle strength and coordination by moving the elbow and shoulder joints and muscles through a range of motion of flexion and extension. The portion of base plate 20 toward the mounting area of small swivel caster 26 is tapered to facilitate arm movement and shoulder rotation. It further allows the muscles and joints to move through a range of motion of flexion and extension to obtain the maximum therapeutic effect during physical therapy and mobility use of the present invention in the horizontal prone position utilizing arm propulsion.

Figure 9:
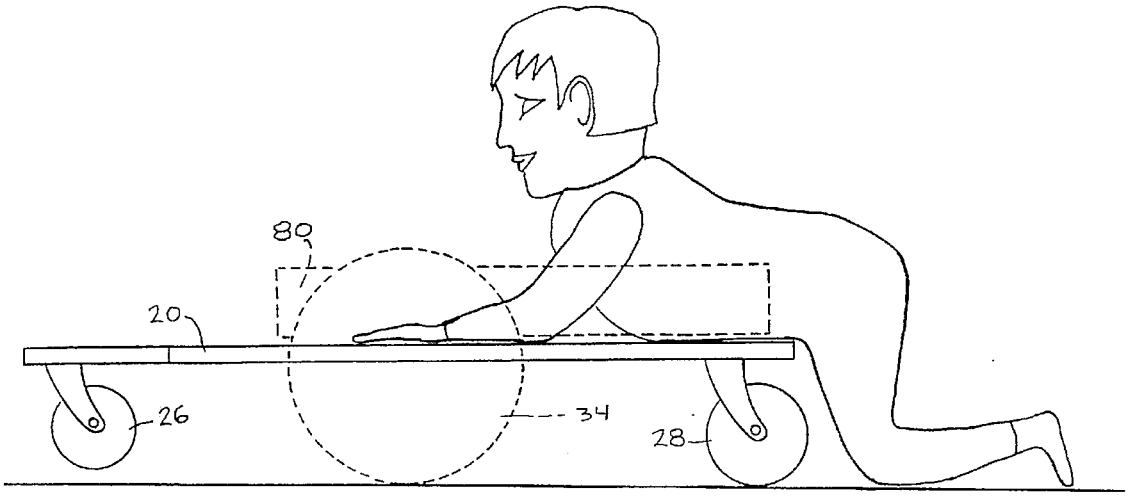
FIG. 9 is a side elevation view of the apparatus with the child placed in the horizontal prone position utilizing leg propulsion.

With specific reference to FIG. 9 and general reference to FIGS. 1–5, the apparatus is set up for the horizontal prone position utilizing leg propulsion by removing back rest 50, back rest brace assembly 52 and center leg brace assembly 90 as previously described. The child is placed with their stomach facing down centered over large swivel casters 28, their shoulders near traction wheels 34, and their hands placed on the upper surface of base plate 20 with their chest and stomach in contact with the upper surface of base plate 20. Propulsion of the apparatus is provided by the lower extremities from the child using their knees and toes in contact with the ground surface. In this position, the hip, leg, and ankle joints in conjunction with the associated muscles are forced through a range of motion of flexion and extension providing exercise and physical therapy.

With specific reference to FIG. 8 and general reference to FIGS. 1–5, the present invention offers the option of being utilized as a scooter board (dolly) where the three swivel casters would contact the ground surface simultaneously. This is accomplished by removing back rest 50, back rest brace assembly 52 and center leg brace assembly 90 as previously described. For this configuration, traction wheels 34 and slidable traction wheel assembly 30 would also be removed. This is accomplished by removing bar nuts 46 from carriage bolts 44. Carriage bolts 44 are then removed from the holes in axle cover 40 and milled side slots 24 and slidable traction wheel assembly 30 can then be removed from the underside of base plate 20.

MODE OF OPERATION—HORIZONTAL SUPINE POSITION

With specific reference to FIG. 10 and general reference to FIGS. 1–4, the apparatus is set up for the horizontal supine position utilizing traction wheel rotation propulsion by removing back rest 50 and back rest brace assembly 52 as previously described. The apparatus is lengthened by installing head rest extension plate 104, carriage bolts 106, and bar nuts 108 as previously described. In this configuration, the child would be placed with their back and the back of their legs contacting the upper surface of base plate 20 with the back of their head contacting the upper surface of head rest extension plate 104. The child is then secured into position with adjustable torso strap 76 and adjustable leg strap 78 as previously described. This position can provide self mobility by the child rotating the traction wheels 34 about traction wheel axle 32 with their hands on the tire tread portion of traction wheels 34 similar to the mode of operation for propelling and steering a standard occupant propelled wheel chair.

MODE OF OPERATION—ORTHOPEDIC BRACING SYSTEM

With reference to FIGS. 1–5, the present invention also provides orthopedic therapy through an adjustable orthopedic brace system. Relating to the orthopedic therapy of the apparatus, the present invention is designed to help align and position the body by allowing the Doctor or Physical Therapist to adjust back rest 50, hip and leg braces 80 in conjunction with center leg brace assembly 90 in order to achieve the maximum effect for orthopedic therapy. The general nature of a child's bony skeletal material is that it is soft and pliable prior to ossification when the bone calcifies and becomes hardened. This soft bone can yield and deform from muscle imbalance. In addition, deformed childhood bones can be straightened by the use of support and corrective forces. The adjustable orthopedic brace system incorporated into the apparatus allows the Doctor or Physical Therapist to prevent or correct these types of childhood bony deformities through orthopedic and manipulative treatment. In addition, the design incorporates this adjustability without the use of any special tools and all adjustments to the hardware are made by using human hands. The adjustable orthopedic brace system can be used in conjunction with conventional braces, splints and or body casts that are worn by the child, if desired. The orthopedic braces can be adjusted to prevent and/or correct long bone deformation or torsional deformities from birth defects, muscle imbalance, muscle spasticity, muscle hypertonia, and muscle hypotonia. Optional padding, restraining straps, and braces that are available from existing manufacturers can also be mounted onto the present invention, if desired, to obtain a therapeutic effect. The apparatus allows the child to be placed into a comfortable position while receiving the required orthopedic therapy. While this orthopedic therapy is being received, the apparatus offers the option of the child being independently mobile, playing or quietly working while being stationary.

Hip and leg braces 80 are adjusted to apply pressure to the affected area and to secure the child into position by loosening bar nuts 88 which are connected to carriage bolts 86. Hip and leg braces 80 can then be moved into the appropriate position by sliding support brackets 82 in a direction generally parallel to milled side slots 24. Further adjustment of hip and leg braces 80 can be accomplished by adjusting the distance between hip and leg braces 80 through sliding milled slots 84 to different positions with respect to the head of carriage bolts 86 which pass through support brackets 82. Once the desired position and pressure against the bone(s) and/or joint(s) is obtained, bar nuts 88 would then be tightened to secure hip and leg braces 80 into a fixed position.

Center leg brace assembly 90 is adjusted to obtain the desired position, pressure, and abduction of the legs. Center leg brace assembly 90 is adjusted to apply pressure to the affected area and to secure the child into position by loosening bar nuts 102 which are connected to carriage bolts 100. Center leg brace assembly 90 can then be moved into the appropriate position by sliding support brackets 94 in a direction generally parallel to milled center slot 22. Further adjustment of center left leg brace element 92L and center right leg brace element 92R can be accomplished adjusting the angle between these elements through sliding milled slots 98 to different positions with respect to the head of carriage bolts 100 which pass through support brackets 94. Once the desired position and pressure against the bone(s) and/or joint(s) is obtained, bar nuts 102 would then be tightened to secure center leg brace assembly 90 into a fixed position.

CONCLUSION, RAMIFICATIONS AND SCOPE

The present invention offers an affordable option for physical therapy, orthopedic therapy, occupational therapy, positive psychological benefits, mobility, independence, maneuverability, portability, quiet play time, and social interaction. The present invention is a versatile medical apparatus which provides multi-functional therapeutic use that can be obtained through the purchase of one piece of equipment. The present invention provides an affordable option by offering a single product that serves the function of several pieces of medical equipment that would have to be purchased separately in order to obtain similar therapeutic functions. Furthermore, the present invention overcomes the disadvantages of the prior art by incorporating adjustability of many of the components to meet the needs of these special children as they grow and their musculoskeletal systems change through growth and/or improve through therapy. The adjustable locations of the components of the present invention can be accomplished by loosening and tightening the bar nuts with human fingers and does not require the use of any special tools. The physical size of the apparatus makes it easily transportable without disassembly which allows utilization in home therapy, school, early intervention groups, and play groups. In addition, the upper surfaces of the hip and leg braces, and center leg brace assembly can be utilized to support a tray, lap desk, books, puzzles, drawing pads, games, toys or other rigid items that can be incorporated into therapy, educational uses or play time.

Although the present invention has been illustrated and described with two large swivel casters 28 mounted on the underside of base plate 20, this configuration has been chosen to improve the stability and prevent overturning of the apparatus. The apparatus would be functionally equivalent if the large swivel casters 28 were removed and a single large swivel caster of the same size was to be installed in a location centered between the depicted locations of large swivel casters 28 in the previous descriptions and drawings. This would result in an apparatus with a four wheel design instead of the five wheel design that has been presented in the specification.

While the above descriptions contain may specificities, these should not be construed as limitations on the scope of the present invention, but rather as an exemplification of the preferred embodiments thereof. Many other variations are possible. For example, the shapes of the rigid pieces described could be changed geometrically, additional holes and slots could be milled through the rigid pieces to accept newly created accessories or provide further adjustability and versatility of the apparatus. The present invention could be constructed from any rigid material, such as wood, plastic, sheet metal, or like material. The five wheel design, slidable traction wheel assembly, adjustable back rest assembly, and orthopedic bracing system could be used as an improvement of existing mobility carts, scooter boards, caster carts, wheelchairs, and other wheeled devices. The apparatus could be converted into a motorized battery operated vehicle with a hand controller, for use in either the seated, prone or supine position, in order to provide mobility for the more severely disabled child. The present invention could be made in any size, accommodating infants to adults. The present invention may also have a potential market as a riding toy and/or exercise device for able bodied children, due to its maneuverability and adjustability. The slidable traction wheel assembly which shifts the center of gravity and ground surface contact to the two large swivel casters or the single small swivel caster may have other uses in robotic vehicles, remote controlled vehicles, or other wheeled vehicles.

Accordingly, the scope of the present invention should be determined not by the embodiments illustrated, but by the appended claims and their legal equivalents.

I claim:

1. An occupant propelled vehicle for a human, comprising:

a) a base plate (20) of elongate rigid material which is tapered at one end, b) having a small swivel caster (26) secured to the underside of the tapered end of said base plate (20) and a large swivel caster (28) secured at each corner of the underside the base plate (20) at the distal end of said small swivel caster (26), and c) having a traction wheel axle (32) secured to the underside of the base plate (20) between the small swivel caster (26) and said large swivel casters (28) with a traction wheel (34) secured to each end of said traction wheel axle (32) thereby allowing the occupant to propel the vehicle along a surface on either a three wheeled wheelbase support or alternately on a four wheeled wheelbase support.

2. The occupant propelled vehicle of claim 1 wherein said traction wheel axle (32) is mounted in a slidable traction wheel assembly (30) installed on the underside of the base plate (20) between the small swivel caster (26) and the large swivel casters (28) thereby allowing a selectable location of said slidable traction wheel assembly (30) between the casters (26 and 28).

3. The occupant propelled vehicle of claim 1 wherein a back rest (50) is secured to the upper side of the base plate (20) thereby allowing self propulsion by a seated human.

4. The occupant propelled vehicle of claim 1 wherein said back rest (50) is slidably located along the upper side of the base plate (20) thereby allowing a selectable location of the back rest (50) between the casters (26 and 28).

5. The occupant propelled vehicle of claim 1 wherein a back rest brace assembly (52) is secured between the back rest (50) and the upper side of the base plate (20) thereby allowing the adjustment of the angle between the back rest (50) and the base plate (20).

6. The occupant propelled vehicle of claim 5 wherein the back rest (50) and the back rest brace assembly (52) are slidably located along the upper side of the base plate (20) thereby allowing a selectable location of the back rest (50) and the back rest brace assembly (52) between the casters (26 and 28).

7. The occupant propelled vehicle of claim 1 wherein a head rest extension plate (104) is secured to the upper side of the base plate (20) thereby allowing self propulsion by a human lying on their back.

8. The occupant propelled vehicle of claim 1 wherein a hip and leg brace (80) is installed along each long edge of the upper side of the base plate (20) for support and orthopedic bracing.

9. The occupant propelled vehicle of claim 8 wherein said hip and leg braces (80) are slidably located along the upper side of the base plate (20) thereby allowing a selectable location of the hip and leg braces (80) between the casters (26 and 28) with varying distances between the hip and leg braces (80) for support and orthopedic bracing.

10. The occupant propelled vehicle of claim 1 wherein a center leg brace assembly (90) is installed along the center of the upper side of the base plate (20) for support and orthopedic bracing.

11. The occupant propelled vehicle of claim 10 wherein said center leg brace assembly (90) is slidably located along the upper side of the base plate (20) thereby allowing a selectable location of the center leg brace assembly (90) between the casters (26 and 28) with varying distances between a center left leg brace element (92L) and a center right leg brace element (92R) for support and orthopedic bracing.

* * * * *